United States Patent [19]

Rannou et al.

[11] 3,942,180

[45] Mar. 2, 1976

[54] WIDE-BAND OMNIDIRECTIONAL ANTENNA

[75] Inventors: Jean Rannou; William Luther, both of Paris, France

[73] Assignee: Thomson-CSF, Paris, France

[22] Filed: Aug. 27, 1974

[21] Appl. No.: 500,940

[30] Foreign Application Priority Data

Aug. 31, 1973 France ..... 73.31520

[52] U.S. Cl. ..... 343/725; 343/773; 343/895; 343/908

[51] Int. Cl.[2] ..... H01Q 21/24

[58] Field of Search ..... 343/726, 725, 773, 774, 343/775, 808, 895, 908

[56] References Cited

UNITED STATES PATENTS

| | | | |
|---|---|---|---|
| 2,174,353 | 9/1939 | Roberts | 343/895 X |
| 2,640,928 | 6/1953 | Kandoian | 343/908 X |
| 3,432,858 | 3/1969 | Brown | 343/895 X |

*Primary Examiner*—Archie R. Borchelt
*Assistant Examiner*—E. R. LaRoche
*Attorney, Agent, or Firm*—Cushman, Darby & Cushman

[57] ABSTRACT

An omnidirectional wide-band antenna which operates with simultaneous horizontal and vertical polarisation consists of two truncated conductive cones which operate as a bi-conical antenna and each truncated cone is associated with a conductor array perpendicular to the axis of the cones. The conductors are in the form of logarithmic spirals.

8 Claims, 4 Drawing Figures

WIDE-BAND OMNIDIRECTIONAL ANTENNA

The present invention relates to wide-band omnidirectional antennas and in particular those which operate with simultaneous horizontal and vertical polarisation.

By a wide-band antenna is meant an antenna which is able to operate in a frequency range of one to three octaves.

Equiangular spiral antennas wound onto a cone of revolution are known, but at very high frequencies the radius of the first turns at the apex of the cone is very small. It is therefore difficult to produce an arrangement to feed such an antenna. At the low frequencies in the band the size of the antenna becomes considerable. Moreover, its polar diagram is not absolutely uniform. It contains discontinuities, which are always a source of trouble. Finally, because of its special shape, such an antenna is difficult to manufacturer.

Also known is the bi-conical antenna, this being described on pages 217–229 of "Antennas" by Kraus, published by McGraw Hill, for example. This antenna is better from the omnidirectional point of view and is small in size, but it is not capable of operating with simultaneous vertical and horizontal polarisation.

The antenna according to the invention does not have these drawbacks. According to a feature of the invention, an omnidirectional wide-band antenna comprises two co-axial truncated conductive cones for forming a bi-conical antenna, and at least one array of conductors which is situated in a plane perpendicular to the said axis and which is connected electrically to each of the truncated cones.

Figure 1:
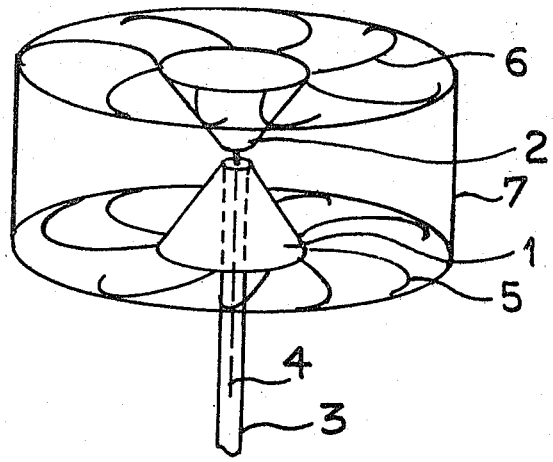
Figure 2:
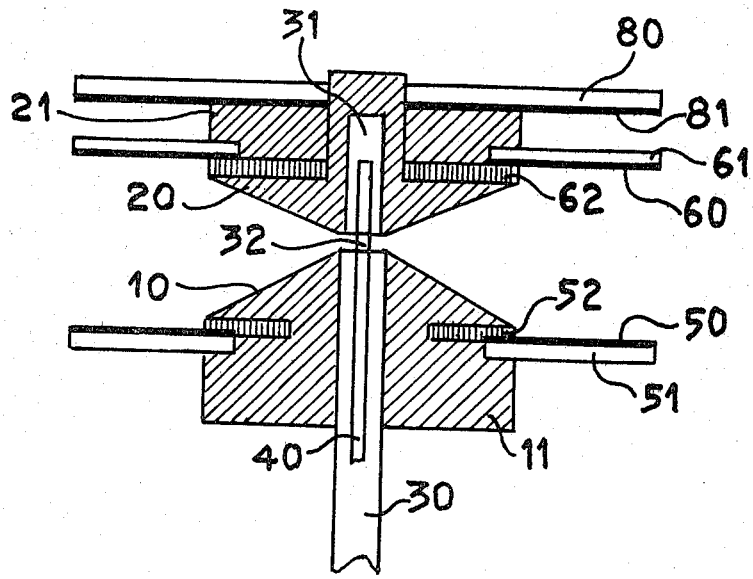

Other features will become apparent from the following description which is given as an example and which is illustrated by the Figures, which show:

FIG. 1, a simplified version of an antenna according to the invention;

FIG. 2, a cross-section of a very-wide-band version, and

Figure 3:
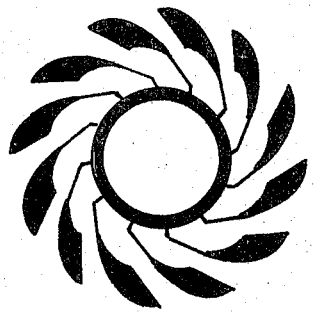
Figure 4:
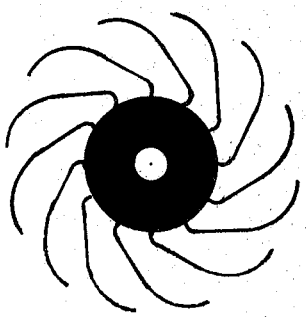

FIGS. 3 and 4, the conductor array used with the version in FIG. 2.

FIG. 1 shows a simplified version of an antenna according to the invention.

The antenna comprises two truncated cones 1 and 2 connected to a co-axial cable. The cones are hollow and are made either of a conductive substance, or of a dielectric substance the surface of which has been metallised. The outer conductor 3 of the co-axial cable is connected to the minor base of cone 1, while the centre conductor is connected to the minor base of cone 2. A first array 5 of conductor wires arranged in a plane perpendicular to the axis of the cones is applied against the major base of cone 1. A second array 6 of conductors is applied against the major base of cone 2. Conductor arrays 5 and 6 are identical. They are formed by a series of metal strands which at one end are connected electrically to the cone to which they are attached and which lie within a disc. A cylindrical protective casing 7, which is permeable to the waves, may be used as a mechanical support for the parts of the antenna as a whole.

The radiating strands may be in the form of logarithmic spirals, for example, and the direction of rotation of the strands forming array 5 is the reverse of that of the strands forming array 6.

The two cones 1 and 2 and the co-axial cable 3, 4 which feeds them together form a wide-band bi-conical antenna. This antenna only operates with vertically polarised waves. The conductive strands, which are laid out in horizontal planes, are able to transmit and receive horizontally polarised waves.

The configuration of the conductive strands in each array is certainly not the only possible one. It is designed to give a polar diagram in azimuth, which is as nearly circular as possible. Two consecutive conductive strands in each array subtract from each other as a result of rotation about the axis of the cones. Two diametrically opposed strands in one of the arrays form a very undirectional antenna. The fact of there being multiple pairs of strands gives a circular radiation diagram. The direction of rotation of the strands in array 6 is the reverse of that of the strands in array 5 so as to make allowance for the opposed phases of the currents supplying the two arrays.

FIG. 2 is a cross-sectional view of a very wide-band version of the antenna according to the invention.

The bi-conical member is once again formed by two metal cones 10 and 20 which are fed by a co-axial cable 30, 40 which terminates in a choke. This choke provides a connection between the end of the co-axial cable and the two cones which are fed in phase opposition.

The outer conductor of the cable is connected to cone 10. The end of the centre conductor 32 projects into a cylindrical recess 31.

A first conductor array 50 is laid out on a dielectric disc and is connected to the major base of cone 10 through an absorbent disc 52. Cone 10 then extends into a cylindrical section 11.

A second conductor array 60 is laid out on a disc 61 which is joined to the major base of cone 20 via an absorbent disc 62. Cone 20 extends into a cylindrical section 21 to which is applied a third disc 80 carrying a third conductor array 81.

Conductor arrays 50 and 60 are identical and are shown in FIG. 3. Each of the conductive strands is in the form of a logarithmic spiral of which the tangent is inclined at 45° with respect to the radius. The ends of the strands are modified so as to become progressively tangent to a circle concentric with the circle formed by the base of the cone.

In addition the strands are splayed for substantially half their length. They could equally well be simply increased in width. At the centre the strands are connected together electrically by a ring which is in contact with the associated absorbent disc. After assembly, since arrays 50 and 60 are facing one another, the directions of rotation of the strands are in fact opposite.

FIG. 4 shows conductor array 81. The shape of the strands is the same as that in FIG. 3 except for the splaying. The direction of rotation of the strands is the same as in array 60.

These circuits are advantageously produced on a polytetrafluor-ethylene substrate by a photo-etching process.

The shape and number of the strands making up the conductor arrays are not, of course, limiting.

The antenna operates in the same way as that in FIG. 1. The effect of the various additional arrangements such as the absorbers and the extra disc is to widen the operating frequency band by, on the one hand, avoiding resonance caused by the length of the horizontal strands and, on the other hand, by apportioning the energy involved between the cones and the horizontal strands.

The antenna described has the advantage of being easy to construct and small in size.

It may be applied to any radar station. Also, by embedding the assembly in a dielectric, it is possible to obtain a sealed antenna which can be used in a marine environment or any corrosive environment.

What we claim is:

1. A wide-band omnidirectional antenna comprising two co-axial truncated conductive cones for forming a bi-conical antenna, at least one array of conductors which are situated in a plane perpendicular to the said axis and which each has one of its ends in electrical contact with the major base of the cone with which it is associated, a cylindrical conductive section extending beyond the major base of one of said cones and a second conductor array placed in electrical contact with the cross-sectional face at the end of said cylindrical section.

2. An antenna according to claim 1, wherein an absorbent disc is inserted between the major base of the cone and the conductor array.

3. An antenna according to claim 1, wherein each conductor array is formed by an assembly of metal strands of logarithmic spiral form, which subtract from one another as a result of rotation about the axis of the cones.

4. An antenna according to claim 3, wherein the conductor array is formed by a photo-etching process on a dielectric substrate.

5. In a wide-band omnidirectional antenna comprising a truncated conductive cone and a disc shaped element mounted adjacent to but spaced from the minor base of said cone having a normal single polarization effect, said disc shaped element comprising a plurality of spiral conductors arranged to provide a substantially circularly polarization effect, so as to provide improved bandwidth and omnidirectional characteristics and the substantial equality of the two polarization effects of the antenna, comprising a further truncated conductive cone and at least one further disc shaped element, said further cone having the same axis as the previous one and being introduced between the previous cone and disc, said previous disc being in electrical connection with the major base of said further cone, and said further disc being in electrical connection with the major base of said previous cone and comprising a plurality of spiral conductors, the direction of rotation of which is the reverse of that of the conductors of the previous disc.

6. An antenna according to claim 5, wherein an absorbent disc is introduced between the major base of each cone and the associated disc element.

7. An antenna according to claim 5, wherein each of said spiral coductors is increased in width from the associated cone to the edge of the disc.

8. An antenna according to claim 5, wherein at least one of the cones is extended beyond its major base by a cylindrical conductive section and a further conductor array is placed in electrical connection with the cross-sectional face at the end of said cylindrical section.

* * * * *